US008324821B2

(12) United States Patent
Wang et al.

(10) Patent No.: US 8,324,821 B2
(45) Date of Patent: Dec. 4, 2012

(54) TWO-WIRED LED LIGHT ADJUSTING SYSTEM

(75) Inventors: Shih-Chieh Wang, Hsinchu (TW); Chiu-Lang Lo, Hsinchu (TW); Pu-Ju Su, Hsinchu (TW); Yu-Huan Tsai, Hsinchu (TW)

(73) Assignee: Weltrend Semiconductor Inc., Science-Based Industrial Park, Hsinchu (TW)

( * ) Notice: Subject to any disclaimer, the term of this patent is extended or adjusted under 35 U.S.C. 154(b) by 237 days.

(21) Appl. No.: 12/975,381

(22) Filed: Dec. 22, 2010

(65) Prior Publication Data

US 2011/0148326 A1 Jun. 23, 2011

(30) Foreign Application Priority Data

Dec. 22, 2009 (TW) ..... 98144238 A

(51) Int. Cl.
*G05F 1/00* (2006.01)

(52) U.S. Cl. ..... 315/194; 315/200 R; 315/224; 315/292; 315/209 R

(58) Field of Classification Search ..... 315/194, 315/200 R, 209 R, 224, 247, 246, 225, 291, 315/307–311
See application file for complete search history.

(56) References Cited

U.S. PATENT DOCUMENTS

2011/0121744 A1* 5/2011 Salvestrini et al. ..... 315/246
2011/0121754 A1* 5/2011 Shteynberg et al. ..... 315/294

* cited by examiner

*Primary Examiner* — Tuyet Thi Vo
(74) *Attorney, Agent, or Firm* — Winston Hsu; Scott Margo

(57) ABSTRACT

A two-wired LED light adjusting system, for controlling the luminance adjustment for a LED lamp module. The light adjusting circuit includes a phase modulating circuit, a LED driving circuit and a controller. The phase modulating circuit generates a phase modulating voltage. The controller detects the phase modulating voltage of various waveforms. When the controller detects the phase modulating voltage of different waveforms, the controller controls the LED driving circuit to enable the LED lamp module to emit light of different luminance according to waveforms of the phase modulating voltage.

10 Claims, 6 Drawing Sheets

TWO-WIRED LED LIGHT ADJUSTING SYSTEM

BACKGROUND OF THE INVENTION

1. Field of the Invention

The present invention is related to a light adjusting system, and more particularly, to a two-wired LED (Light-Emitting Diode) light adjusting system for LED lamp modules.

2. Description of the Prior Art

Conventional light bulbs utilizing tungsten filaments are one of the mainstream tools for providing a light source. However the conventional light bulbs operate with poor efficiency, such that only approximately 10% of electrical energy consumed is converted to light, and the rest is mostly transformed into heat.

In contrast, LEDs are able to convert almost all consumed electrical energy to light. LED lamps are also light sources dissipating relatively little heat. Moreover, LED lamps require less turn-on time than the conventional light bulbs, meaning the light emitted by LED lamps reaches stable luminance faster. Therefore, LED lamps have advantages such as energy savings, less heat dissipated, longer life and shorter turn-on time, etc. As technology advances and costs lower, the conventional light bulbs are gradually replaced by the LED lamps.

However, transitioning light sources to LED lamps may force the user to alter use behaviors, such as ways of replacing light bulbs or ways of adjusting light, etc., causing inconvenience. Therefore, implementing minimal adjustments to the current system/wiring structure, as well as making light adjustment transitions from conventional light bulbs to LED lamps, are important topics when entering a new generation utilizing LEDs as a light source.

SUMMARY OF THE INVENTION

The present invention discloses a two-wired LED (Light-Emitting Diode) light adjusting system for adjusting light of an LED lamp module. The two-wired LED light adjusting system comprises a phase modulating circuit, an LED driving circuit, a rectifying circuit and a controller. The phase modulating circuit is coupled to an alternating current (AC) power source, for generating a phase modulating voltage, wherein the phase modulating circuit partially restrains AC power received from the AC power source for a waveform of the phase modulating voltage to comprise a non-conduction angle. The rectifying circuit is coupled to the phase modulating circuit and the AC power source for rectifying the phase modulating voltage so as to generate a DC (direct current) voltage. The LED driving circuit is coupled to the LED lamp module and the rectifying circuit, for driving the LED lamp module according to the DC voltage. The controller is coupled between the phase modulating circuit and the LED driving circuit, for controlling the LED driving circuit to drive the LED lamp module according to the non-conduction angle of the waveform of the phase modulating voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
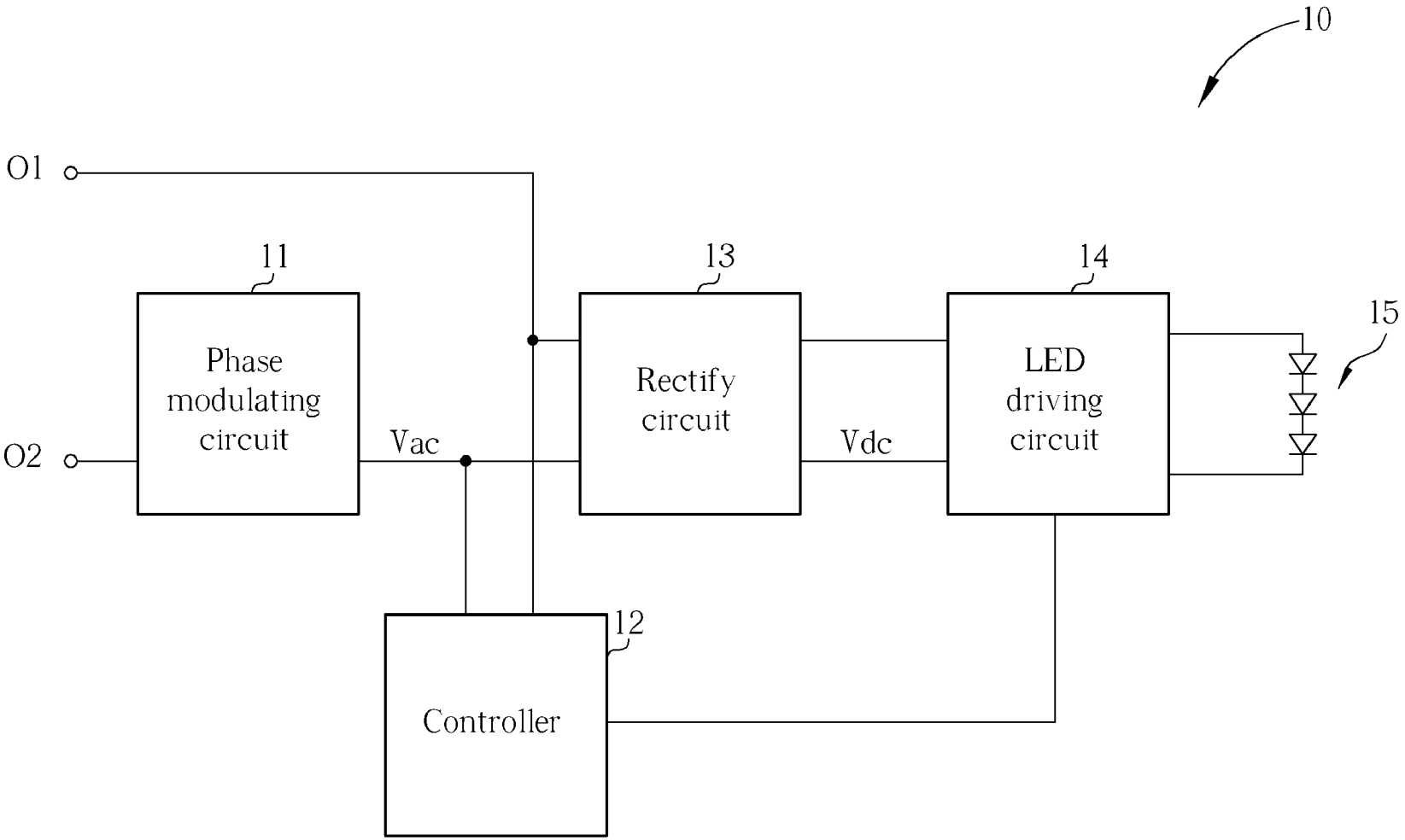
FIG. 1 is a diagram illustrating a two-wired LED light adjusting system of the present invention.

Please refer to FIG. 1. FIG. 1 is a diagram illustrating a two-wired LED light adjusting system 10 of the present invention. The two-wired LED light adjusting system 10 comprises a phase modulating circuit 11, a controller 12, a rectifying circuit 13, an LED driving circuit 14 and an LED lamp module 15. The phase modulating circuit 11 is coupled to an AC (Alternating Current) power source. As illustrated in FIG. 1, the AC current source comprises two input ends O1 and O2, for inputting AC power, wherein the AC power source can be a commercial power source for instance. The phase modulating circuit 11 is coupled between the input end O2 of the AC power source and the rectifying circuit 13. The AC power source provides AC power to the phase modulating circuit 11. The phase modulating circuit 11 adjusts the received AC power and accordingly generates phase modulating voltage Vac to the rectifying circuit 13. The controller 12 is coupled between the phase modulating circuit 11 and the LED driving circuit 14, for detecting the phase modulating voltage Vac outputted from the phase modulating circuit 11. The rectifying circuit 13 is coupled to the phase modulating circuit 11 and the AC power source, for rectifying the phase modulating voltage Vac so as to generate a DC (direct current) voltage Vdc. The LED driving circuit 14 is coupled to the controller 12, the LED lamp module 15 and the rectifying circuit 13 at the same time, for receiving the DC voltage Vdc. The phase modulating circuit 11 generates a plurality of phase modulating voltages Vac of different waveforms. The controller 12 controls the LED driving circuit 14 to drive the LED lamp module 15 to generate light of different luminances, according to different waveforms of the phase modulating voltage Vac.

Figure 2:
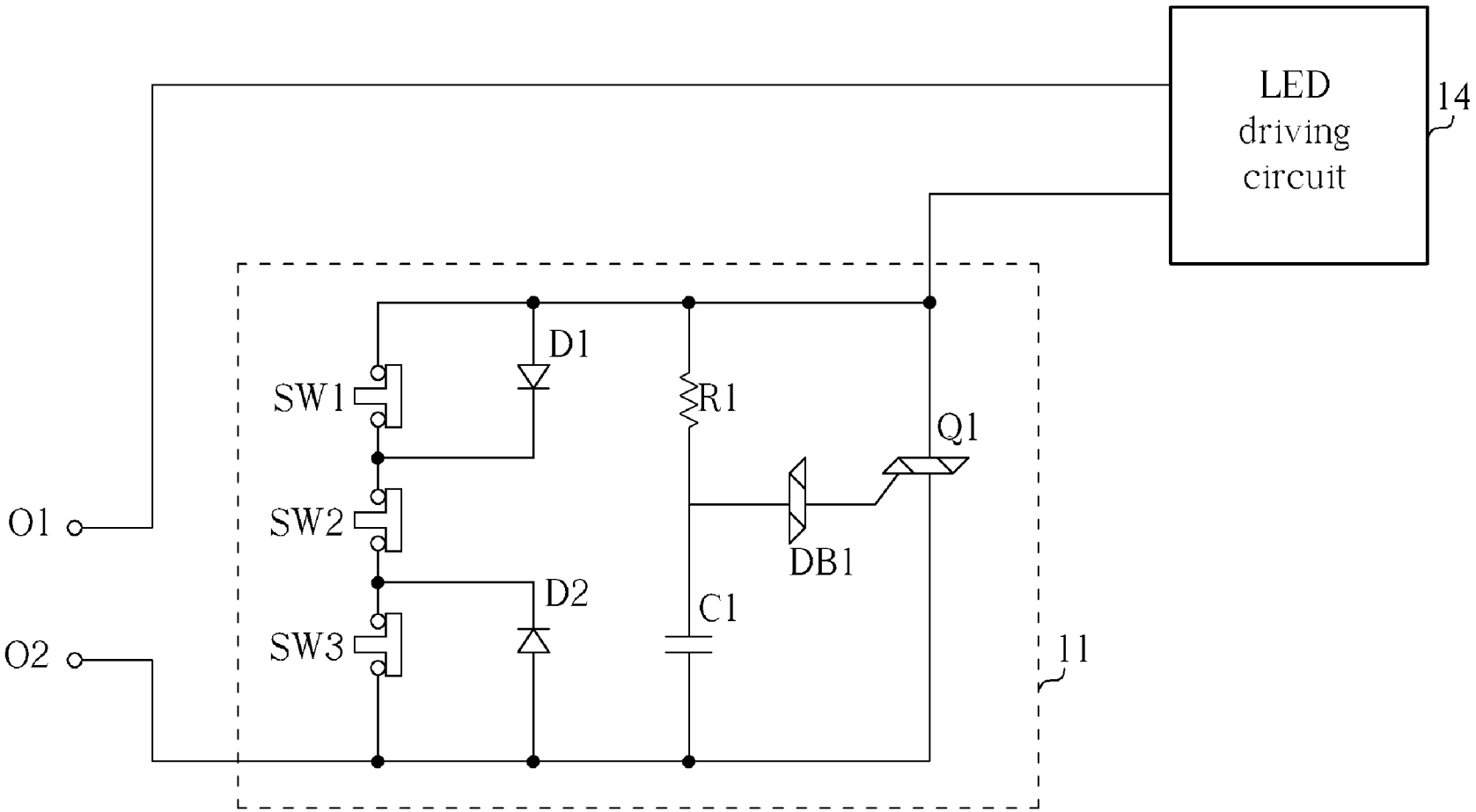
FIG. 2 is a diagram illustrating the phase modulating circuit of the present invention.

Please refer to FIG. 2. FIG. 2 is a diagram illustrating the phase modulating circuit 11 of the present invention. The phase modulating circuit 11 comprises diodes D1, D2, a resistor R1, a capacitor C1, a DIAC (Diode Alternate Current Switch) DB1 and a TRIAC (Triode Alternate Current Switch) Q1. TRIAC Q1 is equivalent to a switch device comprising silicon-controlled rectifiers (SCRs) inversely coupled in parallel and sharing one gate end. Silicon controlled rectifier is a gate-end-controlled component, and is equivalent to a diode when turned on. Therefore, TRIAC Q1 serves a similar function as a silicon-controlled rectifier, but the flow of the loading current is bi-directional. DIAC DB1 is coupled to the TRIAC Q1, for triggering the TRIAC Q1.

In one embodiment of the present invention, the phase modulating circuit 11 further comprises switches SW1, SW2 and SW3. Switch SW2 is coupled between switches SW1 and SW3, and switch SW1 and SW3 are coupled in parallel to the diodes D1 and D2 respectively. The input end O2 of the AC power source is coupled to the switch SW3. Switches SW1, SW2 and SW3 can be utilized to control the phase modulating circuit 11 to generate phase modulated voltages Vac of different waveforms, for performing light adjustment of the LED lamp module 15. For instance, turning off switch SW1 decreases luminance of the LED lamp module 15; turning off switch SW3 increases the luminance of the LED lamp module 15; turning off switch SW2 toggles the LED lamp module 15 on and off. It is noted that switches SW1, SW2 and SW3 of the present embodiment are not compulsory components. As long as the controller 12 detects the waveforms of the phase modulating voltage Vac, and accordingly controls the LED driving circuit 14 to drive the LED lamp module 15 to carry-out corresponding actions, such as increasing/decreasing luminance or turning on/off, etc., then such characteristics are within the scope of the present invention.

Figure 3:
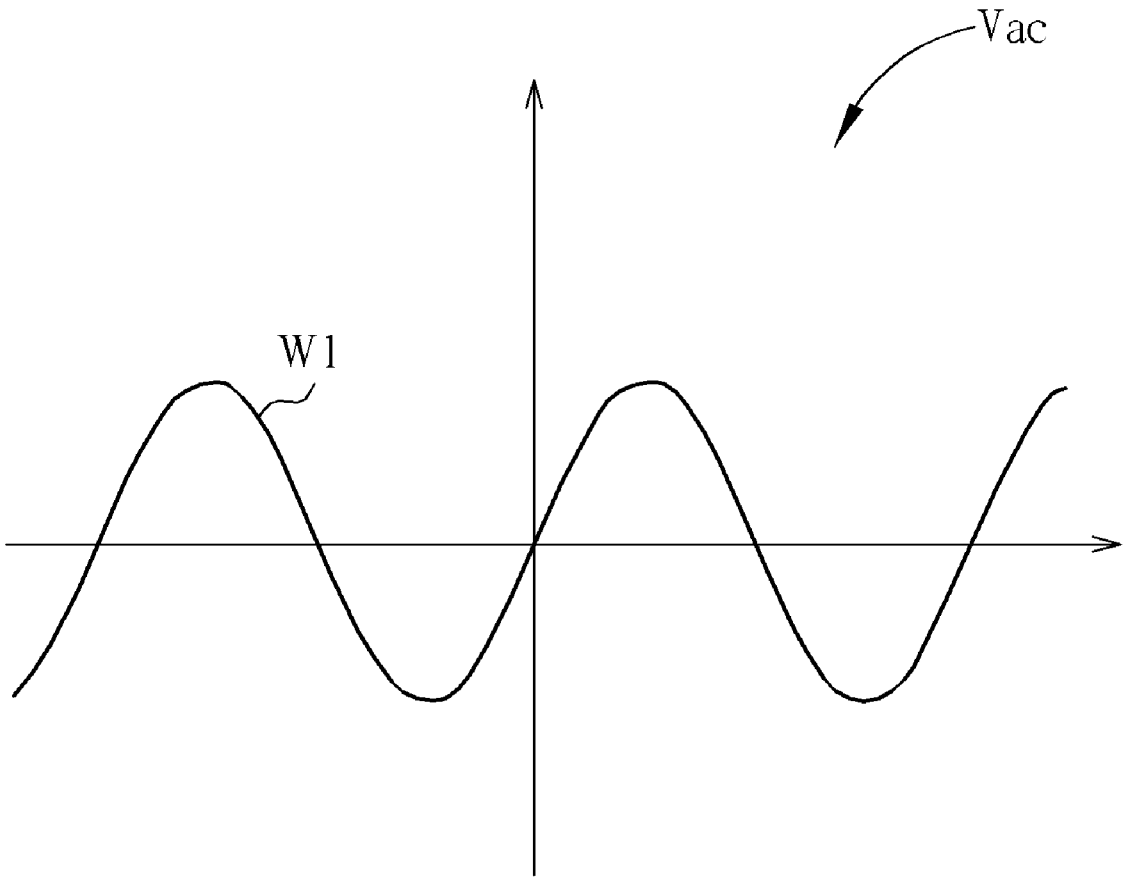
FIG. 3 is a diagram illustrating a first waveform of the unadjusted phase modulated voltage generated by phase modulating circuit of the present invention.

Please refer to FIG. 3. FIG. 3 is a diagram illustrating a first waveform W1 of the unadjusted phase modulated voltage Vac generated by phase modulating circuit 11 of the present invention. In the present embodiment, the switches SW1, SW2 and SW3 are turned on. Therefore, the phase modulating circuit 11 directly transmits the AC power received from the AC power source to the rectifying circuit 13. For instance, the AC power the phase modulating circuit 11 receives from the AC power source is a sine wave, so the phase modulating voltage Vac outputted from the phase modulating circuit 11 is a similar sine wave. In the present embodiment, the controller 12 detects the phase modulating voltage Vac comprises a first waveform W1, and accordingly the controller 12 controls the LED driving circuit 14 to turn on the LED lamp module 15.

Figure 4:
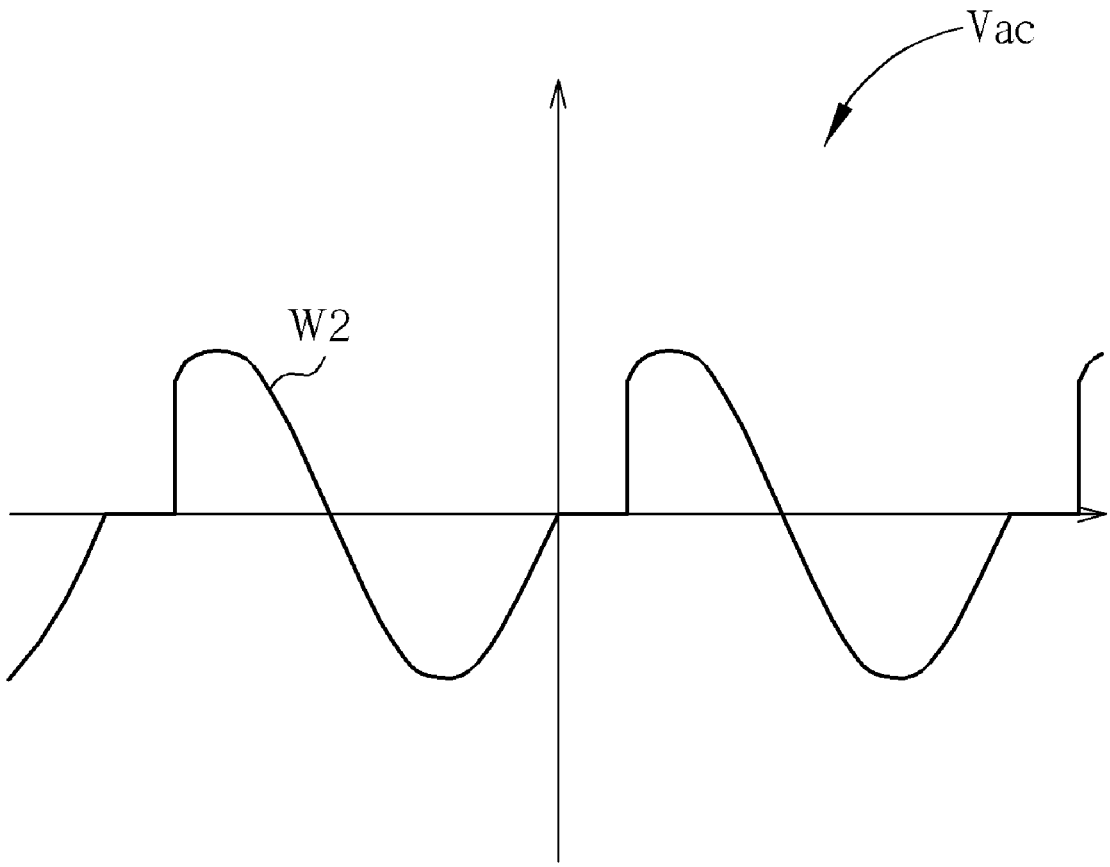
FIG. 4 is a diagram illustrating a second waveform of the phase modulated voltage generated by phase modulating circuit of the present invention.

Please refer to FIG. 4. FIG. 4 is a diagram illustrating a second waveform W2 of the phase modulated voltage Vac generated by phase modulating circuit 11 of the present invention. In the present embodiment, the switch SW3 is not turned on, but switches SW1 and SW2 are turned on. When switch SW3 is not turned on, the AC power the phase modulating circuit 11 received from the AC power source flows through the diode D2. Since the diode D2 is in the reverse direction relative to the current flow of the AC power, only the negative voltage portion of the AC power passes through the diode D2. The positive voltage portion of the AC power charges the RC circuit which consists of the resistor R1 and the capacitor C1. Therefore, the second waveform W2 of the phase modulating voltage Vac comprises a non-conduction angle between 0-90 degrees of phase in every cycle, as illustrated in FIG. 4. In the present embodiment, the controller 12 detects the phase modulating voltage Vac comprises the second waveform W2, and accordingly the controller 12 controls the LED driving circuit 14 to increase luminance of the LED lamp module 15.

Figure 5:
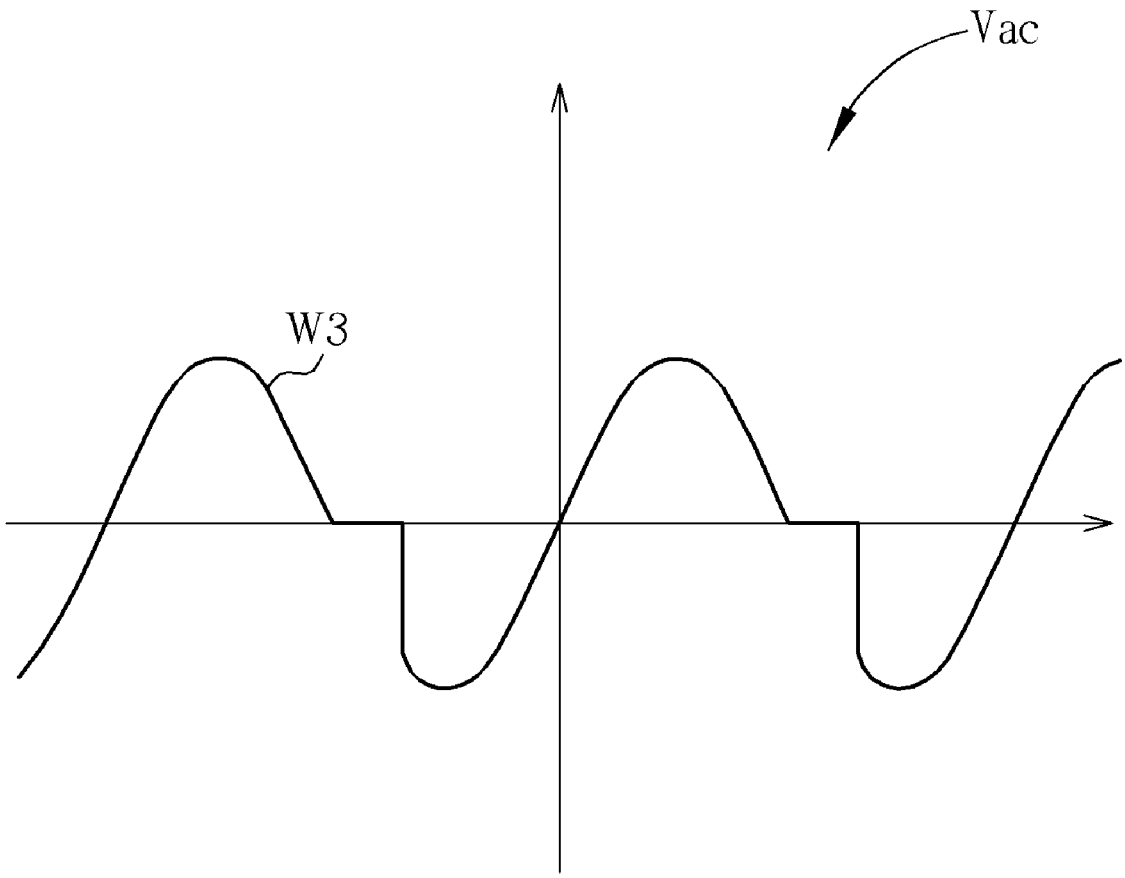
FIG. 5 is a diagram illustrating a third waveform of the phase modulated voltage generated by phase modulating circuit of the present invention.

Please refer to FIG. 5. FIG. 5 is a diagram illustrating a third waveform W3 of the phase modulated voltage Vac generated by phase modulating circuit 11 of the present invention. In the present embodiment, the switch SW1 is not turned on, but the switches SW2 and SW3 are turned on. When the switch SW1 is not turned on, the AC power the phase modulating circuit 11 received from the AC power source flows through the diode D1. Since the diode D1 is in the forward direction relative to the current flow of the AC power, only the positive voltage portion of the AC power passes through the diode D1. The negative voltage portion of the AC power charges the RC circuit which consists of the resistor R1 and the capacitor C1. Therefore, the third waveform W3 of the phase modulating voltage Vac comprises a non-conduction angle between 180-270 degrees of phase in every cycle, as illustrated in FIG. 5. In the present embodiment, the controller 12 detects the phase modulating voltage Vac comprises the third waveform W3, and accordingly the controller 12 controls the LED driving circuit 14 to decrease luminance of the LED lamp module 15.

Figure 6:
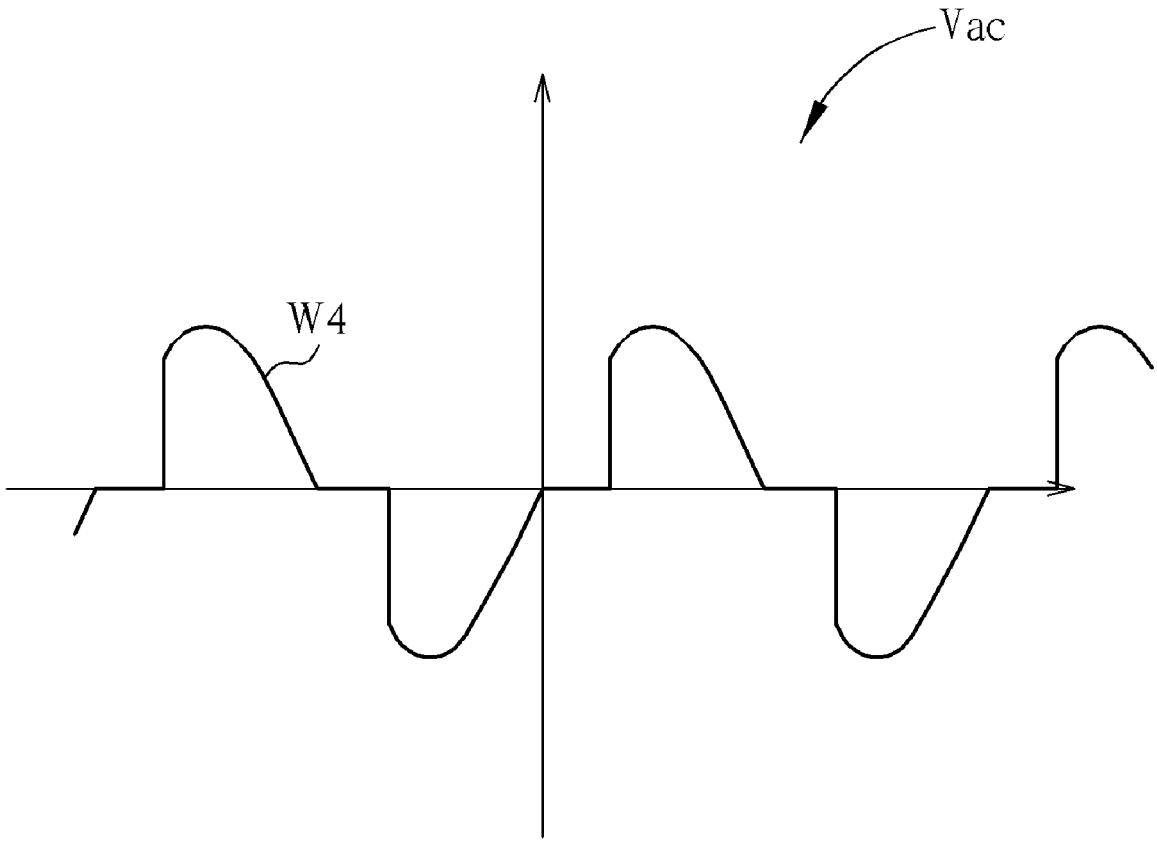
FIG. 6 is a diagram illustrating a fourth waveform of the phase modulated voltage generated by phase modulating circuit of the present invention.

Please refer to FIG. 6. FIG. 6 is a diagram illustrating a fourth waveform W4 of the phase modulated voltage Vac generated by phase modulating circuit 11 of the present invention. In the present embodiment, the switch SW2 is not turned on. When the switch SW2 is not turned on, the AC power the phase modulating circuit 11 received from the AC power source does not flow through diodes D1 or D2. Both the positive and negative voltage portions of the AC power charge the RC circuit which consists of the resistor R1 and the capacitor C1. Therefore, the third waveform W4 of the phase modulating voltage Vac comprises a non-conduction angle between 0-90 degrees of phase and between 180-270 degrees of phase in every cycle, as illustrated in FIG. 6. In the present embodiment, the controller 12 detects the phase modulating voltage Vac comprises the fourth waveform W4, and accordingly the controller 12 controls the LED driving circuit 14 to turn off the LED lamp module 15.

By adjusting resistance of resistor R1 and capacitance of capacitor C1, the time duration in which the RC circuit is charged by the AC power is also changed, meaning the degree of non-conduction angles in waveforms of the phase modulating voltage Vac are also changed accordingly. For instance, if the non-conduction angle of the phase modulating voltage Vac in each cycle exceeds a predetermined value, for instance, the non-conduction angle in the positive domain of the waveform exceeds 90 degrees of phase, then the RC circuit consumes an excessive amount of the AC power received by the phase modulating circuit 11 from the AC power source. If RC circuit consumes excessive input AC power, subsequent components of the two-wired LED light adjusting system 10 may not be able to operate. On the other hand, if the non-conduction angle of the phase modulating voltage Vac in each cycle is too small, controller 12 may not be able to recognize the non-conduction angle, e.g. it may be difficult for the controller 12 to distinguish the difference between noise and the phase modulating voltage Vac, resulting in failure to recognize waveforms of the phase modulation voltage Vac. In the present embodiment, the non-conduction angle of the phase modulating voltage Vac exists between 0-90 degrees of phase and/or between 180-270 degrees of phase.

This way, the two-wired LED light adjusting system 10 is able to digitize the analog inputs, such as switches SW1-SW3. For instance, when the controller 12 detects phase modulating voltage Vac is the first waveform W1, second waveform W2, third waveform W3 or fourth waveform W4, the controller 12 can utilize binary bits such as "00", "01", "10" and "11" to represent the first to fourth waveforms W1-W4 respectively. In addition, according to waveforms of phase modulating power Vac, the controller 12 may utilize different ways (e.g. changing 2 bits to 3 bits such as "000", "001", "010" . . . etc.) to represent a variety of waveforms of the phase modulating power Vac, and the controller 12 accordingly controls the LED driving circuit 14 for the LED lamp module 15 to generate more different levels of luminance, or carry out more different actions.

Please note that when the controller 12 detects different waveforms of the phase modulating voltage Vac, corresponding actions that the controller 12 controls the LED driving circuit 14 to perform are not limited to the above mentioned embodiments. The actions the controller 12 controls the LED driving circuit 14 to perform according to different waveforms of the phase modulating voltage Vac can be predetermined. For instance, when the controller 12 detects the phase modulating voltage Vac comprises the second waveform W2, the controller 12 is not limited to controlling the LED driving circuit 14 to increase the luminance of the LED lamp module 15. According to another embodiment of the present invention, when the phase modulated voltage Vac is detected to comprise the second waveform W2, the controller 12 can be configured in advance to control the LED driving circuit 14 to drive the LED lamp module 15 to perform different actions, such as decreasing the luminance of the LED lamp module 15.

Furthermore, actions carried out by the LED driving circuit 14 are not limited to functions of light adjustment or turning on/off the LED lamp module 15. In another embodiment of the present invention, when a predetermined waveform of the phase modulating circuit 14 is detected, the controller 12 controls the LED driving circuit 14 to drive the LED lamp module 15 to generate special effects, such as flickering.

Those skilled in the art will readily observe that numerous modifications and alterations of the device and method may be made while retaining the teachings of the invention.

What is claimed is:

1. A two-wired LED (Light-Emitting Diode) light adjusting system for adjusting light of an LED lamp module, comprising:

a phase modulating circuit, coupled to an alternating current (AC) power source, for generating a phase modulating voltage, wherein the phase modulating circuit partially restrains AC power received from the AC power source for a waveform of the phase modulating voltage to comprise a non-conduction angle;

a rectifying circuit, coupled to the phase modulating circuit and the AC power source for rectifying the phase modulating voltage so as to generate a DC (direct current) voltage;

an LED driving circuit, coupled to the LED lamp module and the rectifying circuit, for driving the LED lamp module according to the DC voltage; and a controller, coupled between the phase modulating circuit and the LED driving circuit, for controlling the LED driving circuit to drive the LED lamp module according to the non-conduction angle of the waveform of the phase modulating voltage.

2. The two-wired LED light adjusting system of claim 1, wherein the phase modulating circuit comprises a first switch, a second switch and a third switch.

3. The two-wired LED light adjusting system of claim 2, wherein when the first switch, the second switch and the third switch are all turned on, the phase modulating voltage generated by the phase modulating circuit is a first sine wave.

4. The two-wired LED light adjusting system of claim 3, wherein when the phase modulating voltage is the first sine wave, the controller controls the LED driving circuit to drive the LED lamp module to generate a first luminance.

5. The two-wired LED light adjusting system of claim 2, wherein when the third switch is not turned on and the first switch and the second switch are turned on, the phase modulating voltage generated by the phase modulating circuit is a second sine wave, and 0-90 degrees of phase of the second sine wave comprises the non-conduction angle.

6. The two-wired LED light adjusting system of claim 5, wherein when the phase modulating voltage is the second sine wave, the controller controls the LED driving circuit to drive the LED lamp module to generate a second luminance.

7. The two-wired LED light adjusting system of claim 2, wherein when the first switch is not turned on, and the second and the third switch are turned on, the phase modulating voltage generated by the phase modulating circuit is a third sine wave, and 180-270 degrees of phase of the third sine wave comprises the non-conduction angle.

8. The two-wired LED light adjusting system of claim 7, wherein when the phase modulating voltage is the third sine wave, the controller controls the LED driving circuit to drive the LED lamp module to generate a third luminance.

9. The two-wired LED light adjusting system of claim 2, wherein when the second switch is not turned on, the phase modulating voltage generated by the phase modulating circuit is a fourth sine wave, and each of 0-90 degrees and 180-270 degrees of phase of the fourth sine wave comprises the non-conduction angle.

10. The two-wired LED light adjusting system of claim 9, wherein when the phase modulating voltage is the fourth sine wave, the controller controls the LED driving circuit to turn off the LED lamp module.

* * * * *